US005331928A

United States Patent [19]

Wood

[11] Patent Number: 5,331,928

[45] Date of Patent: Jul. 26, 1994

[54] VARIABLE COMPRESSION PISTON

[75] Inventor: Charles D. Wood, San Antonio, Tex.

[73] Assignee: Southwest Research Institute, San Antonio, Tex.

[21] Appl. No.: 892,570

[22] Filed: Jun. 3, 1992

[51] Int. Cl.[5] ..... F02B 75/04

[52] U.S. Cl. ..... 123/78 B

[58] Field of Search ..... 123/78 R, 78 B

[56] References Cited

U.S. PATENT DOCUMENTS 3,450,113 6/1969 Bachle ..... 123/78 B 4,079,707 3/1978 Karaba et al. ..... 123/78 B

*Primary Examiner*—Noah P. Kamen

*Attorney, Agent, or Firm*—Charles W. Hanor

[57] ABSTRACT

An engine having a variable piston capable of adjusting an engine's compression ratio while cranking or operating throughout an engine's speed/load range. Control may be obtained through varying the volume of lubricating fluid supplied to an inertia operated pump/accumulator device located in each multi-element piston. Fluid is supplied to said pump/accumulator device by means of a low pressure jet directed into an opening in the accumulator. No direct plumbing connection is required between the fluid source and the pump/accumulator device. Each piston includes an inner element conventionally mounted on a connecting rod and an outer element slidably mounted above and around said inner element. A chamber is formed between the upper surface of said inner element and the inside top surface of said outer element. Supplying a fluid into this cavity extends the upper portion of the piston, raising the engine compression ratio. Said chamber is constructed with a small orifice draining to a second smaller cavity within the multi-element piston and used to modify relative motions. When fluid supply is less than said drain rate, the piston upper portion will retract and compression ratios will decrease. When fluid supply exceeds the drain rate, compression ratios increase. The system also allows for remote control of compression ratio through variation in the volume of oil supplied through supply jets. The system also insured a steady supply of fluid for piston cooling.

2 Claims, 5 Drawing Sheets

VARIABLE COMPRESSION PISTON

BACKGROUND OF THE INVENTION

Field of the Invention

The present invention relates to an internal combustion engine and more specifically to an arrangement which permits the compression ratio of said engine to be under an operator's control.

A number of methods have been patented for the purpose of varying piston-engine compression ratios during operation. One method is typified by U.S. Pat. No. 4,286,552 (Tsutsumi). This patent teaches a secondary piston in the cylinder head of the engine which is retracted to increase head space volume (lower compression ratio) and extended to raise compression ratio. Many forms of this idea exist, varying in the means of control, but all requiring highly specialized cylinder head construction.

A second class of compression ratio control is shown in U.S. Pat. No. 4,469,055 (Caswell). This patent teaches a multi-element piston in which the upper and outer element is spaced outwardly through the addition of fluid into a cavity formed between two elements of the piston, lengthening it with respect to the wrist pin and raising the compression ratio. This design requires for each piston at least a two-passage flexible line connected from a separate pump to maintain control and fluid circulation for cooling. As pistons move up and down several inches per stroke at 50 to 100 per second, it is seen that this approach may be impractical.

A Japanese Provisional Patent 5,891,340 (Kokai) places an eccentric bearing between the piston and the connecting rod. The eccentric has two positions, for high and low compression, and requires two oil passages drilled through each connecting rod, the crankshaft and all crankpins plus a control valve and hydraulic positioning means in each cylinder.

A large number of patents based on the multi-element piston in various forms have been issued. A common element in these patents is that they are controlled by fluids fed through a drilled crankshaft, crankpins and connecting rods or through an external jointed or flexible fluid tight conduit to their various adjustable pistons. A recent example is U.S. Pat. 4,934,347 (Suga). This piston responds to maximum cylinder pressure and raises compression by fluid inflow when such pressure is below a selected value. Thus the effect of this system is automatic and out of the hands of the operator. A common problem in pistons of this type is that under certain conditions they have little flow through the fluid chamber and overheating can break down the oil therein causing sludge or even coke formations, destroying the piston's function or even the piston itself.

An object of the present invention is to provide a means for controlling an engine's compression ratio without the use of conduits linking the source of the control fluid to the piston.

Another object is to provide for raising the pressure of the control fluid to working within the piston body so that the delivery of control fluid to the piston may take place at low pressures.

Another object is that control of compression ratio may be achieved by control of the volume of fluid flow through fixed jets. Another object is that a continuous flow of control fluid will pass through the piston to provide lubrication and cooling.

Another object is that the invention may be applied to conventional engine designs without alteration of blocks, cylinder heads, crankshafts or connecting rods.

SUMMARY OF THE INVENTION

The present invention is a variable compression ratio system utilizing a multi-element piston responsive to the amount of hydraulic fluid supplied to the piston, said fluid supply under the control of an operator. The multi-element piston contains a first variable volume chamber between its first and second elements which receives fluid from an inertia-operated pump carried internally in the second piston element. A second variable volume chamber also exists between the second and the third piston elements, so positioned that an increase in size of the first variable volume chamber reduces the size of the second variable volume chamber and vice-versa. A small orifice drains the first variable volume chamber into the second variable volume chamber. The second variable volume chamber has a second drain directly into the engine crankcase. Hydraulic fluid is supplied to the inertia-operated pump by means of a hydraulic fluid jet mounted to the engine below the piston and directed into the inlet of an accumulator device. This accumulator device is also carried in the second piston element. The drain from the second variable volume chamber is designed to sharply increase its restriction before said variable volume chamber is exhausted, thereby avoiding metal-to-metal strikes during operation. The system of the present invention may be designed to increase compression under cranking or operating conditions by supplying jet flow in greater quantity than the drain rates of the variable volume chambers; in like manner, low jet flow will decrease compression.

DETAILED DESCRIPTION OF THE INVENTION

Figure 1:
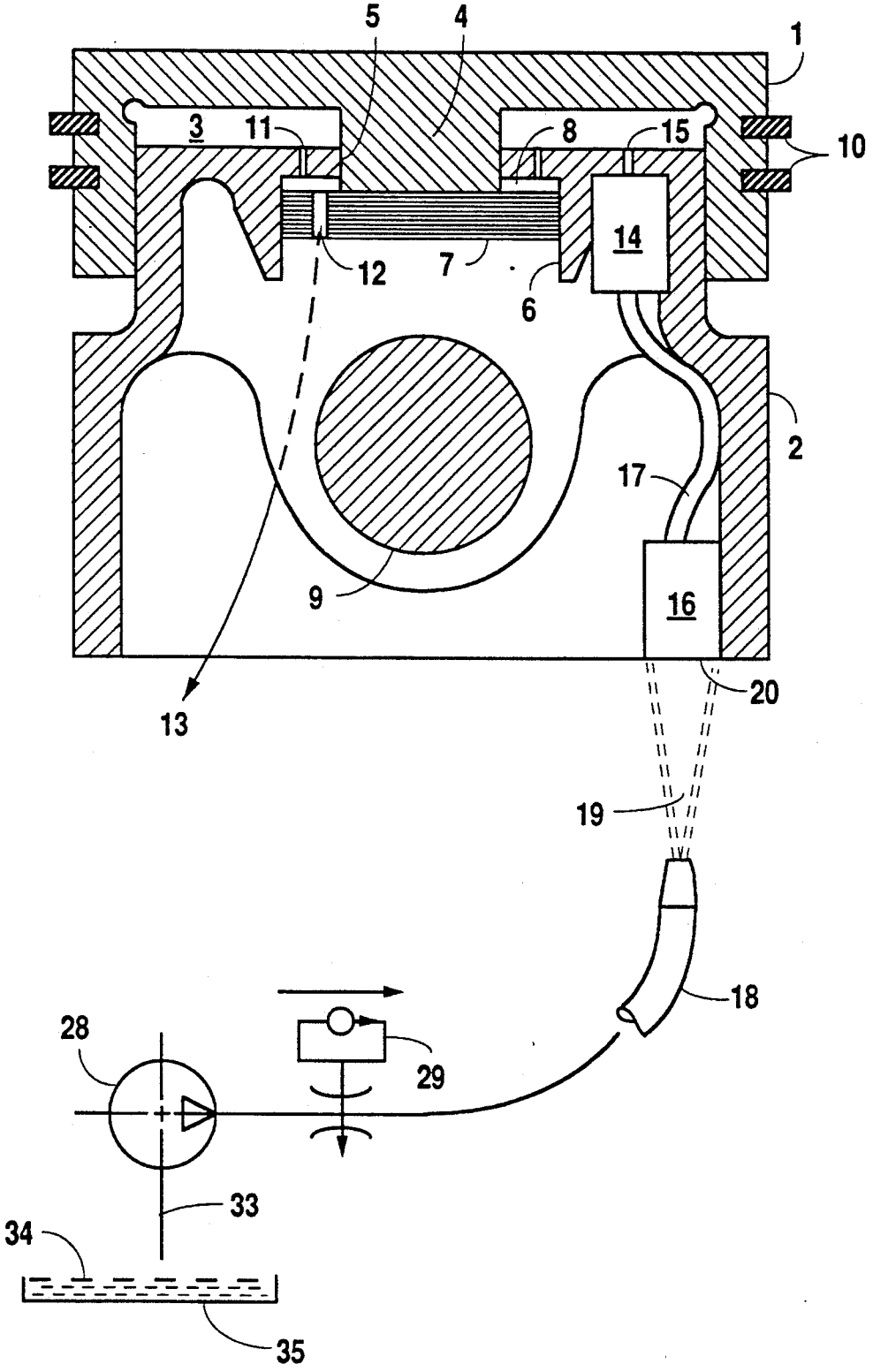
FIG. 1. is a schematic illustration of a preferred embodiment of the present invention.

FIG. 1 illustrates the basic elements of the preferred embodiment of the invention. A movable piston cap element 1 carrying piston rings 10 fits slidably over piston body element 2 so that a first variable volume chamber 3 is formed there-between.

A centrally located cylindrical extension 4 of the lower surface of piston cap element 1 extends down through hole 5 in the top of piston body element 2 and enters in enlarged cylindrical bore 6 of piston element 2 directly below and concentric with hole 5. A piston 7 is attached to extension 4 to form a second variable volume chamber 8 between said piston and a portion of piston body 2. Piston body 2 is operatively connected to a conventional connecting rod by means of conventional wrist pin 9.

Orifice 11 exists in piston body 2 interconnecting variable volume chamber 3 and variable volume chamber 8. A second orifice 12 exists in piston 7 to interconnect variable volume chamber 8 and the engine crankcase volume 13. An inertial pump generally designed 14 is mounted in a bore existing in body element 2 and passage 15 connects said pump with variable volume chamber 3. A hydraulic accumulator 16 is also mounted in piston body element 2 below pump 14 and hydraulically connected to it by passage 17. Stationary oil jet 18 directs a stream of hydraulic fluid 19 directly into o the bottom opening of accumulator 16 indicated at 20.

Said jet 18 is provided for each piston and is mounted to the engine frame. Jet 18 is supplied by the engine oil pump if it has sufficient capacity or alternately by a separate pump. The volume of fluid supplied to said jet 18 is adjusted by variable flow control 29 under the control of the engine operator. Variable flow control 29 may alternately be adjusted by servomechanisms responding to engine sensors for automatic compression control. Pump 28 draws crankcase fluid 24 from crankcase or other reservoir 35 through suction conduit 33.

Figure 2:
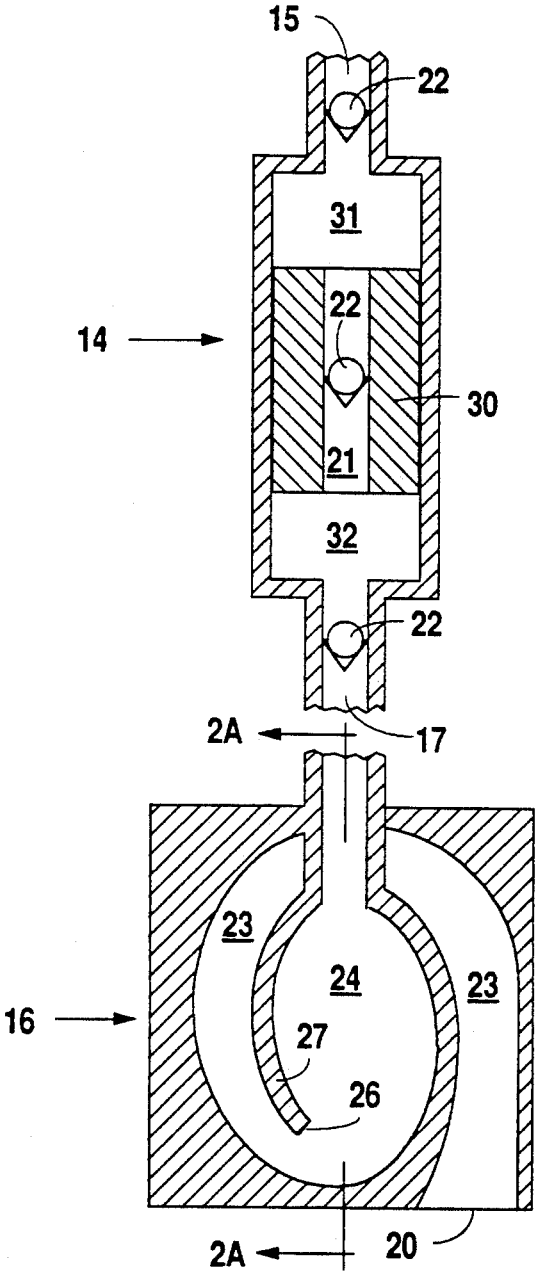
FIG. 2. shows an inertia-operated pump, check valves, accumulator and connecting fluid passage in their approximate relative positions.
Figure 2A:
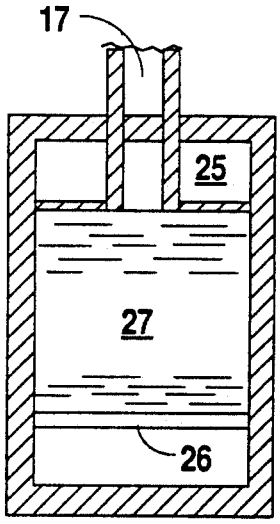
FIG. 2*a* shows a cross-section of the accumulator.

FIG. 2 is a representation of pump 14 and accumulator 16. Pump 14 comprises a high density piston cylinder 30 with a central passage 21 and a check valve 22 mounted therein. Said check valve 22 is oriented for passage of fluid there through only from bottom to top (upwardly). Adjacent to pump 14 and mounted in pump outlet passage 15 of piston element 2 is a second check valve 22 also oriented to pass fluid from bottom to top. A third check valve 22 is located in the pump inlet passage 17 and is likewise oriented for fluid passage from bottom to top. The three check valves 22 may be all alike, different, or any combination in response to design considerations, or all above elements may be included in a self-contained inertial pump and mounted into piston body element 2 as a unit as shown in FIG. 1.

The accumulator 16 shown in side and front views in FIG. 2 is commonly referred to as a "snail" type configuration. Oil enters an opening in the bottom surface 20 and is carried up the internal passage 23 by the force of the jet and is deflected by curvature of passage 23 to pass through zones 25 on both sides of the central pipe 17' which forms that portion of interconnecting passage 17 existing within accumulator 16. Inertia of the jet stream carries hydraulic fluid on around passage 23 until it passes the lower extremity 26 of inner wall 27 and enters central cavity 24. The foregoing action will take place whether the piston is moving up or down or during the momentary pause at top and bottom "dead center" of the piston cycle. The velocity of the fluid jet always exceeds the maximum piston speed if the hydraulic oil pressure upstream of the jet is greater than 10 psig.

Once fluid has entered central cavity 24, it is clear that positive and negative accelerations will not cause oil to flow out of cavity 24 except by way of the passage 17 located in the upper surface of said cavity at times when forced accelerations on said accumulator are directed downward. At such times, contents of cavity 24 are urged upward by their own inertial forces. These conditions exist in the last half of the exhaust stroke, the first half of the intake stroke, the last half of the compression stroke and the first half of the power stroke. During the remaining half of these four strokes, inertial forces push the contents of cavity 24 downward but there is no escape in that direction without passing back through zone 25. That is impossible since zone 25 is above the top of cavity 24 and the inertial force is downward. From the foregoing it is seen that fluid from cavity 24 will be present at the entrance of passage 17 whenever accelerations on the piston are downward, and that the inertial effects of the hydraulic fluid itself will contribute to the effective output pressure of this pumping system.

Operation of the inertial pump produces hydraulic fluid pressure at outlet passage 15 during portions of the engine cycle in which accelerations on said piston (and the pump piston cylinder 30) are downward. Downward acceleration on the pump assembly causes piston 30 within to exert force upward due to the inertia created by its mass. This tendency to rise can only be resisted by the hydraulic fluid above said piston 30 so that a pressure is created therein. When said pressure reaches a level above that existing in variable volume chamber 3, hydraulic fluid will flow out of pump 14 through passage 15 and into variable volume chamber 3, extending piston cap 1 outwardly from piston body 2. It is notable that the same conditions of acceleration that produce pressure to pump fluid into variable volume chamber 3 also affect piston cap I, urging it upward and thereby reducing the fluid pressure in variable volume chamber 3. This favorable condition allows the inertial pump system to add fluid to variable volume chamber 3 at very low engine RPM so that the system is operable even at cranking speeds.

When pump 14 is passing fluid up through check valve 22' into passage 17 and on into variable volume chamber 3, check valve 22 in the central passage of cylinder 30 is closed to prevent back flow through cylinder 30 but check valve 22" is open passing fluid into the variable volume chamber 32 below cylinder 30 as the piston rises on its pumping stroke and increases said variable volume chamber.

Inertial forces urging cylinder 30 on its pumping stroke likewise act on the fluid in accumulator cavity 24 and passage 17, maintaining an inlet pressure at check valve 22" and assuring that variable volume chamber 32 will remain filled (so long as accumulator 16 is supplied with fluid at least to the rate at which it is being pumped). When jet supply rates are less than the potential pumping rate, all fluid supplied to the accumulator will collect at the pump inlet for each stroke and thus control of pumping rate will be maintained at said rate of supply.

After the pumping phase, when accelerations on the pumping system are upward, piston cylinder 30 and all fluid within the pump/accumulator system are urged downward by inertial reaction to said accelerations. Check valve 22'' prevents back flow of fluid from variable volume chamber 32 and check valve 22' prevents fluid returning from outlet passage 15 and variable volume chamber 3.

Cylinder 30 is urged downward more strongly than said fluid because of its higher density and consequent higher inertia. Increased fluid pressure below piston 30 (variable volume chamber 32) and decreased fluid pressure above (variable volume chamber 31) force check valve 22 open and fluid passes from variable volume chamber 32 into variable volume chamber 31 as cylinder 30 moves downwardly. When accelerations again reverse as the pistons begin to approach the top of the engine cylinders, one pumping cycle is complete and another begins.

Figure 8:
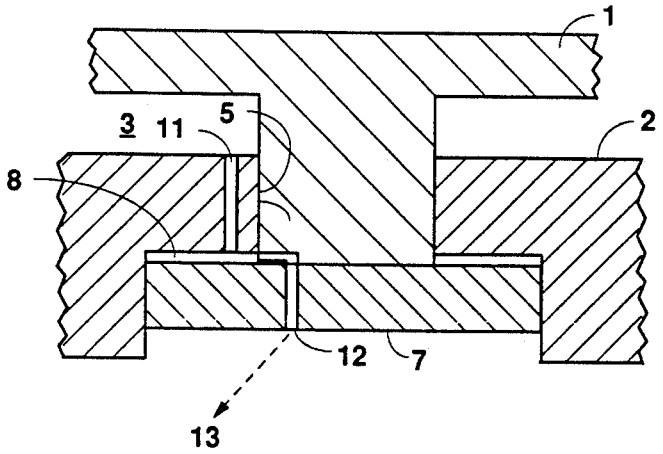
FIG. 8. shows drain orifice arrangement for variable variable volume chamber 8 which increases its restriction as piston element 1 approaches its upper position.

FIG. 8 illustrates a means by which piston cap 1 is prevented from rising to its upper limit causing piston 7 to strike piston body 2 where it forms the top surface of variable volume chamber 8. By placing orifice 12 as shown so that it communicates with variable volume chamber 8 slightly above the upper surface of piston 7, fluid draining from variable volume chamber 8 through orifice 12 to crankcase 13 will experience a large increase in flow resistance as the communicating upper end of orifice 12 rises inside tight-fitting hole 5 near the upper limit of motion for cap I relative to piston body 2. At all other locations, the orifice opening is directly exposed to variable volume chamber 8. Fluid 34 which has passed through orifice 12 into crankcase volume 13 will drain into engine pump 35 where it is available to be picked up by suction line 33 of pump 28 recirculated through the system (See FIG. 1).

Results shown in FIGS. 3, 4, 5, 6, and 7 were obtained using a computer model of the system. The following engine dimensions were developed and used for the results shown in said figures.

| | | |
|---|---|---|
| Piston Displacement | 58.5 in. 3 [each] | (959 cc) |
| Connecting Rod Length | 3.25 inches | (82.5 mm) |
| Bore | 4.1 inches | (104 mm) |
| Stroke | 4.44 inches | (113 mm) |
| Weight of Piston Cap 1 | 1.2 pounds | (.54 Kg.) |
| Area of Variable volume chamber 3 | 10 square inches | (6452 Sq. mm) |
| Area of Variable volume chamber 8 | 1 square inch | (645 Sq. mm.) |
| Area of Orifice 10 | .0003 square inch | (.1963 Sq. mm.) |
| Area of Orifice 12 | .003 square inch | (2.01 Sq. mm) |
| Pump Piston Weight | .1 pounds | (45 grams) |
| Pump Piston Area | .196 square inch | (126.6 Sq. mm.) |

Figure 3:
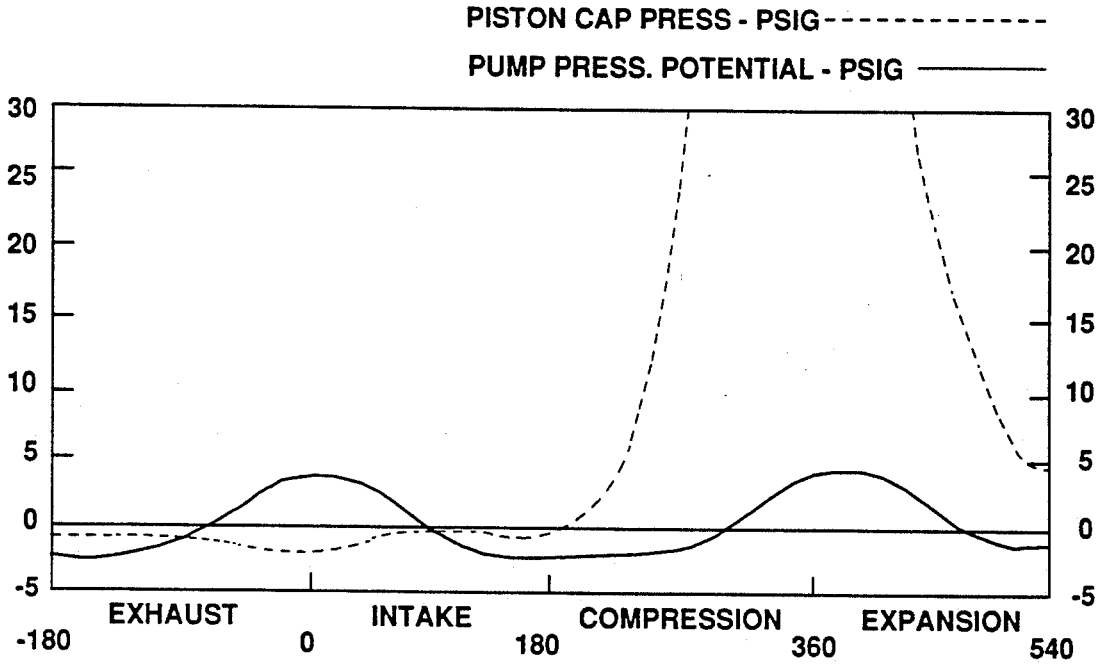
FIG. 3. charts pressure available from an inertia-driven pump and fluid pressure in variable volume chamber 3 during a complete cranking cycle at 300 RPM with high fluid supply.

The pumping and control system were tested under a range of conditions using the parameters listed above; a particularly critical condition being the low speed test, results of which are shown in FIG. 3. FIG. 3 represents an engine cycle (2 crankshaft revolutions) with a trace representing inertial pump outlet pressure and a second trace representing pressure in variable volume chamber 3. Both traces are keyed to degrees of crankshaft revolution through one complete four-stroke engine cycle at cranking speed (300 RPM), without firing. As may be seen in the crosshatched area, pumping can occur at low speeds even through pump pressure potential is less than 5 PSI.

Figure 4:
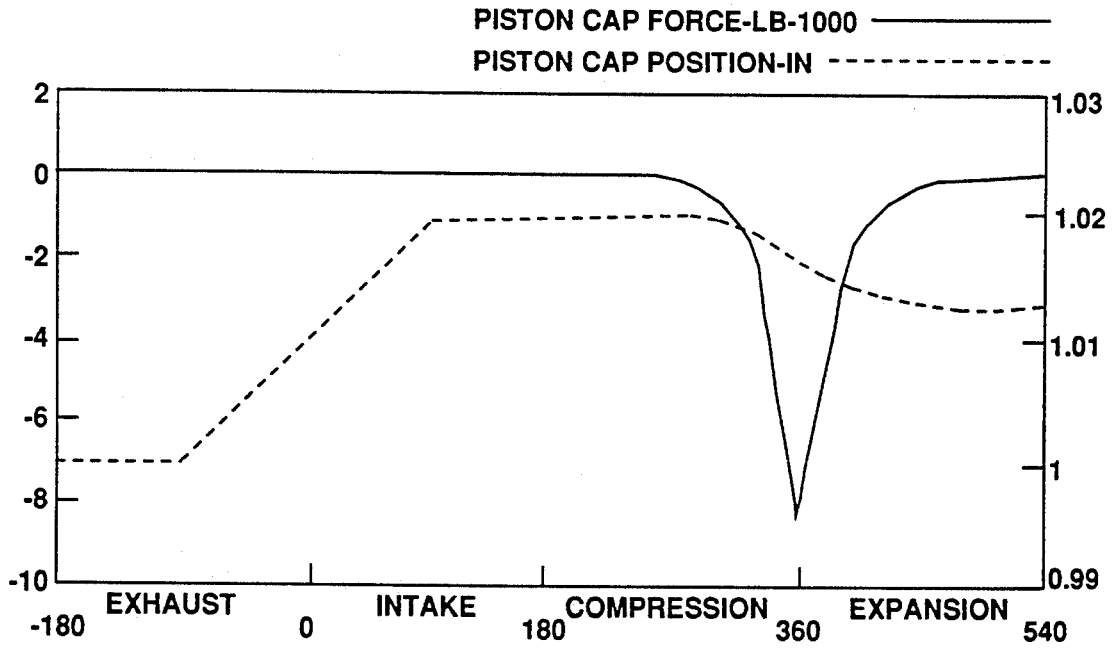
FIG. 4. charts force acting on top of piston element 1 and relative positioning of piston element 1 to piston element 2 over one complete engine cranking cycle at 300 RPM with high fluid supply.

FIG. 4 shows piston force (the sum of acceleration and gas pressure forces on the piston cap) and the position of the piston cap relative to the piston body over one complete cycle at 300 RPM, without firing. Upward forces on the piston cap are positive. The initial piston position is 1.0 inch, which is a reference value. During the exhaust stroke, oil is pumped into variable volume chamber 3 which raises the piston cap with respect to the piston body. When the acceleration forces become negative, pumping ceases and piston cap 1 moves downward (slowly) due to leakage through orifices 11 and 12. This downward movement is faster near top dead center on the compression stroke because of the high piston force resulting from gas pressure in the cylinder that produces a high pressure in variable volume chamber 3 and consequently a high leakage rate. Over the cycle shown on FIG. 4, the piston cap has a net upward movement of 0.0125 inch. With this rate of upward movement of the piston cap, it would require 32 engine cycles (6.4 seconds) to raise the compression ratio from 12 to 24. It would require 65 engine cycles (13 seconds) to raise the compression ratio from 6 to 12.

Figure 5:
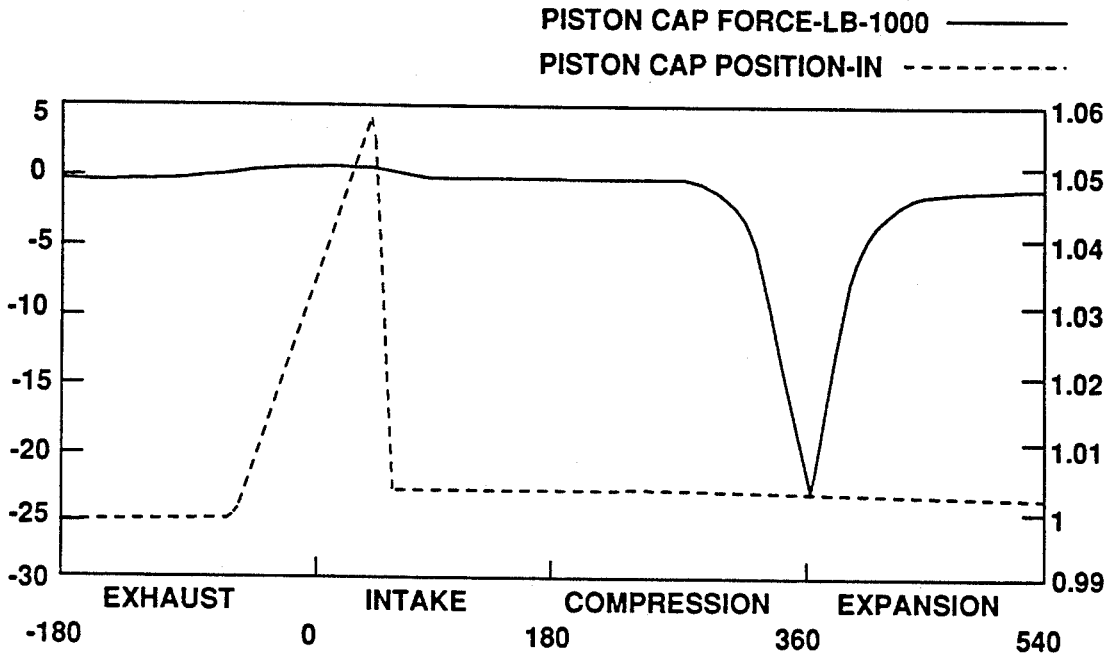
FIG. 5. charts force on acting top of piston element 1 and relative positioning of piston element 1 to piston element 2 over one complete engine cycle at full load and 2500 RPM; high fluid supply.

FIG. 5 shows piston force and position at 2500 rpm and full load. The available pump pressure now exceeds 250 psig (1724 kPa-gauge) because of increased acceleration force. The increase of cap position near top dead center exhaust occurs because the upward force on the piston cap due to acceleration produces a negative pressure in variable volume chamber 3 and vaporizes the oil there. The larger orifice 12 then allows a more rapid upward motion of the piston cap.

This movement is relatively large but is controlled by the size of the orifice 12 from lower variable volume chamber 8 to the crankcase volume 13. While this motion can be reduced by reducing the diameter of orifice 12, it cannot be totally eliminated. It may be desirable to provide means to prevent the lower piston from striking the piston body 2. One method to accomplish this is shown in FIG. 8, where orifice 12 is arranged so that its restriction is increased as the piston cap approaches its upper position.

When the force begins to reverse direction, the vapor collapses and the piston cap position decreases. In this cycle the net increase in piston cap height is 0.0027 inch. Increasing compression ratio from 12 to 24 would require 3.6 seconds with this oil pumping rate, and increasing the compression ratio from 6 to 12 would require 8 seconds.

Figure 6:
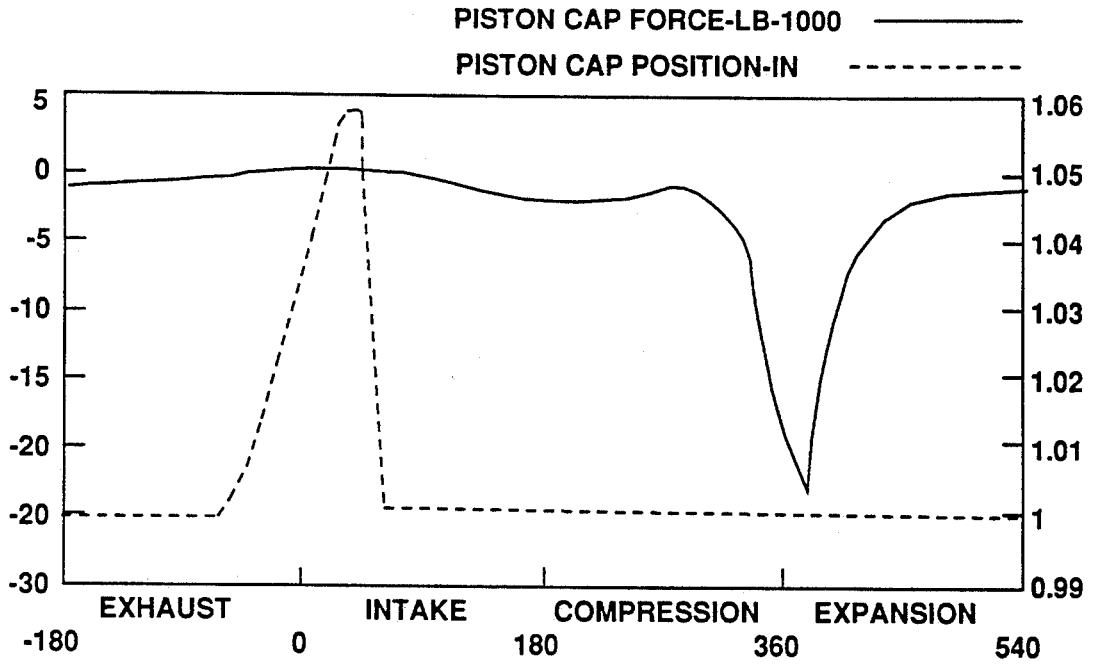
FIG. 6. charts the conditions of FIG. 5 except that the fluid supply rate has been reduced, resulting in a loss of fluid in variable volume chamber 3 and a net relative height decrease-between piston elements 1 and 2.
Figure 7:
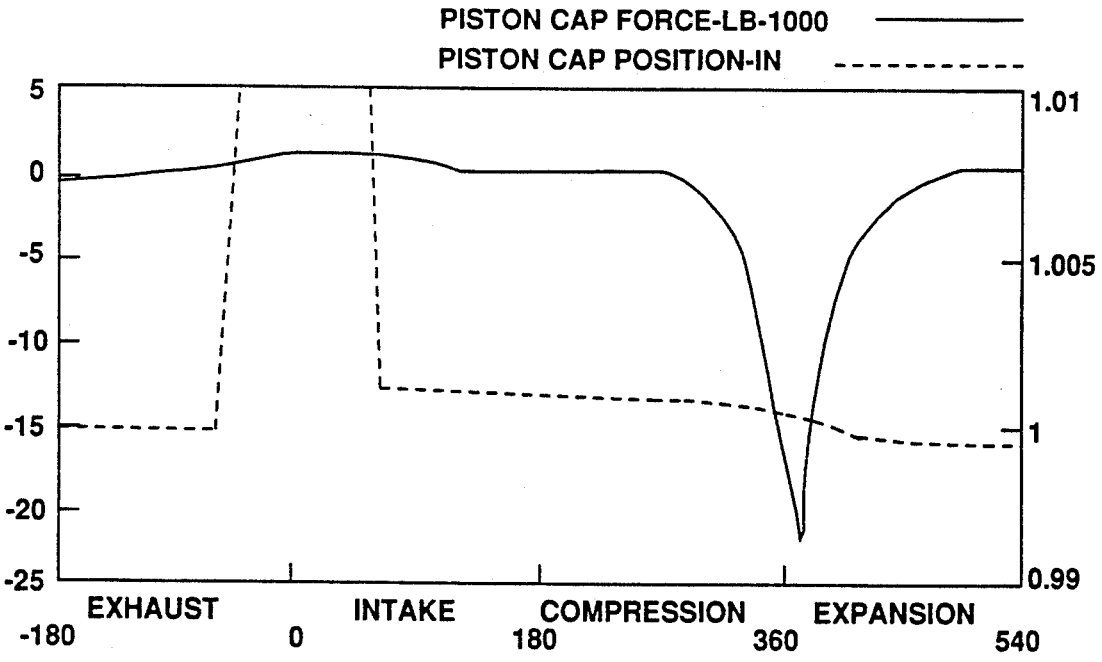
FIG. 7. is an expanded scale graph identical to FIG. 6.

At low oil delivery rates, when the compression ratio is being reduced or held at its lowest value, oil vapor will form within the pump when the plunger is forced down by inertia while the pump is not filled with oil. However, the plunger will not strike the pump body so long as any oil is supplied to the accumulator and the method of FIG. 8 is used. FIGS. 6 and 7 show the same load and speed but with a reduced pumping rate so that the compression ratio decreases. FIG. 7 is an expanded-scale graph identical to FIG. 6.

Results of computer modeling show that a jet flow rate of 0.26 gallon per minute (1 liter/min./cyl.)is sufficient to increase the compression ratio at all loads and speeds. A jet flow rate of 0.1 gallon per minute (0.38 liter/min./cyl.) will result in a decreasing compression ratio at all loads and speeds. Capacity of the accumulator must be at least 0.19 cubic inch (3.1 cc) to satisfy pumping requirements at all loads and speeds.

Dimensions used in this test program are not necessarily optimum design dimensions since only a limited number of arrangements were tested with the computer model. However, this design demonstrates technical feasibility and it is likely that a large number of other combinations might provide similar results.

The invention has the following advantages. There are no internal seals. The system is designed to leak so seals are unnecessary. The piston cap carries the piston rings which eliminate the need for sealing the hydraulic system from high pressure gases in the cylinder. The engine is unmodified except for new pistons and the addition of an oil jet for each cylinder. Connecting rods and crankshaft are unaffected. Over the range of engine operating conditions, it is possible to increase the compression ratio from minimum to maximum value in a relatively few engine cycles. Three check valves are the only valves required in this piston mounted inertial pumping system. It is noted that these check valves must be light weight and able to endure many engine cycles. The invention provides a continuous flow of oil through both variable volume chambers 3 and 8 for piston cooling and for protection of the oil from overheating and sludge formation.

Benefits available through compression ratio control are many, but an important advantage is increased fuel efficiency. The present invention fulfills the need for a simple method and apparatus capable of continuously increasing, decreasing or maintaining engine compression ratios under all operating conditions at the discretion of the engine operator. The modifications required are basically confined to the pistons so that proven technology is available to all other areas of engine design in utilizing this concept; in fact, it is well suited for retrofitting onto existing engines.

I claim:

1. A variable compression engine comprising:

a first reciprocal piston cap element;

a second piston element reciprocally disposed to said first reciprocal piston cap element to define a first variable volume chamber there-between and a third piston element at the end of a centrally located means attached to said first reciprocal piston cap element to form a second variable volume chamber between said third piston element and said second piston element;

means for supplying hydraulic fluid to said variable volume fluid chambers;

a fluid communicating orifice between said first variable chamber and said second variable chamber; and a fluid communicating orifice for draining said second variable chamber.

2. A variable compression ratio system for an internal combustion engine, comprising:

a multi-element piston means having first and second concentric variable volume chambers responsive to the amount of hydraulic fluid supplied to the first and second variable volume chambers so that an increase in size of the first variable volume chamber reduces the size of the second variable volume chamber;

a hydraulic fluid supply means for supplying hydraulic fluid to the first and second variable volume chambers.

means for communicating hydraulic fluid from the first variable volume chamber into the second variable volume chamber; and means for draining hydraulic fluid from the second variable volume chamber.

* * * * *